US006851798B2

(12) United States Patent
Koshikawa et al.

(10) Patent No.: US 6,851,798 B2
(45) Date of Patent: Feb. 8, 2005

(54) LIQUID CONTAINER AND METHOD FOR DISCONNECTING LIQUID CONTAINER

(75) Inventors: Hiroshi Koshikawa, Kanagawa (JP); Shozo Hattori, Tokyo (JP); Hajime Yamamoto, Kanagawa (JP); Eiichiro Shimizu, Kanagawa (JP); Hiroki Hayashi, Kanagawa (JP); Kenji Kitabatake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 10/350,050

(22) Filed: Jan. 24, 2003

(65) Prior Publication Data

US 2003/0122910 A1 Jul. 3, 2003

Related U.S. Application Data

(62) Division of application No. 09/969,821, filed on Oct. 4, 2001, now Pat. No. 6,540,342.

(30) Foreign Application Priority Data

Oct. 5, 2000 (JP) ..... 2000-306262

(51) Int. Cl.[7] ..... B41J 2/175
(52) U.S. Cl. ..... 347/85; 347/87
(58) Field of Search ..... 347/49, 85, 86, 347/87

(56) References Cited

U.S. PATENT DOCUMENTS

| | | | | |
|---|---|---|---|---|
| 4,183,031 | A | 1/1980 | Kyser et al. | 346/140 R |
| 5,500,663 | A | 3/1996 | Ujita et al. | 347/86 |
| 5,509,140 | A | 4/1996 | Koitabashi et al. | 347/86 |
| 5,742,311 | A | 4/1998 | Koitabashi et al. | 347/86 |
| 5,815,183 | A | 9/1998 | Sasaki | 347/86 |
| 5,975,330 | A | 11/1999 | Sasaki et al. | 220/495.01 |
| 6,033,063 | A | 3/2000 | Tomikawa et al. | 347/87 |
| 6,135,590 | A | 10/2000 | Saeki et al. | 347/86 |
| 6,145,970 | A | 11/2000 | Sasaki et al. | 347/85 |
| 6,170,939 | B1 | 1/2001 | Ujita et al. | 347/86 |
| 6,382,783 | B1 | 5/2002 | Hayashi et al. | 347/85 |
| 6,382,786 | B2 | 5/2002 | Iwanaga et al. | 347/86 |
| 6,443,567 | B1 | 9/2002 | Hayashi et al. | 347/85 |
| 6,450,631 | B1 | 9/2002 | Hayashi et al. | 347/86 |
| 6,474,797 | B2 | 11/2002 | Kurata et al. | 347/85 |
| 2001/0045976 | A1 | 11/2001 | Ara et al. | |
| 2002/0167571 | A1 | 11/2002 | Hayashi et al. | |

FOREIGN PATENT DOCUMENTS

| | | |
|---|---|---|
| EP | 711667 | 5/1996 |
| JP | 59-131837 | 7/1984 |
| JP | 59-215870 | 12/1984 |
| JP | 9-267483 | 10/1997 |
| JP | 10-278293 | 10/1998 |

*Primary Examiner*—Anh T. N. Vo
(74) *Attorney, Agent, or Firm*—Fitzpatrick, Cella, Harper & Scinto

(57) ABSTRACT

A liquid container which is in detachably connectable to a supply tube which is in fluid communication with a liquid ejection recording head, the liquid container including a liquid accommodating portion for accommodating liquid to be supplied to the liquid ejection recording head and a supply port for permitting supply of the liquid to the recording head from the liquid accommodating portion by connection of the liquid container to the liquid ejection recording head, the liquid container includes a capillary force generating member for generating a capillary force to absorb the recording liquid deposited on the surface of the supply tube and in the supply port into a space, other than the liquid accommodating portion, in the liquid container; wherein a capillary force A generated in an absorption region for absorbing the recording liquid remaining in the supply port adjacent the supply port of the capillary force generating member and a capillary force B in a storing region for storing the recording liquid absorbed in the absorption region, satisfy A<B.

4 Claims, 8 Drawing Sheets

LIQUID CONTAINER AND METHOD FOR DISCONNECTING LIQUID CONTAINER

This application is a division of application Ser. No. 09/969,821, filed Oct. 4, 2001, now U.S. Pat. No. 6,540,342.

FIELD OF THE INVENTION AND RELATED ART

The present invention relates to a liquid container used as an ink container for an inkjet recording apparatus, or the like. It also relates to a liquid ejecting recording apparatus in which such a liquid container is removably mountable, and a method for disconnecting such a liquid container.

There are various methods for supplying ink to a recording head which ejects ink as recording liquid. According to one of such methods, a liquid container (ink container) is rendered separable from a recording head, or a liquid supply line connected to a recording head, and such an ink container is replaced.

There has been known an ink container structure such that a piece of porous material such as sponge, or a piece of fibrous material, is stored, preferably in a compressed state, in a manner to fill the entirety of an ink container to store ink. Also, there have been known various structural arrangements such that, from the standpoint of improvement in storage efficiency, ink is directly stored in an ink container, or is stored in such an ink pouch which deforms in response to ink consumption. For example, Japanese Laid-Open Patent Application 9-267483 (U.S. Pat. No. 6,145,970) proposes an ink container having such a structural arrangement. According to this structural arrangement, the ink container is a multi-layer ink container, the wall of which has multiple layers separable from each other, and in which ink is directly stored to improve ink storage efficiency. It is made with the use of a molding technology such as blow molding.

There have been made various proposals to prevent the ink leakage which occurs as such as ink container as the one described above is repeatedly connected or disconnected.

For example, Japanese Laid-Open Patent Application 10-278293 (U.S. Pat. No. 6,135,590) discloses an ink cartridge which is enabled to deliver ink by being penetrated by a hollow connecting needle. It comprises: a boxy case; an ink storage portion, or the internal space of the ink cartridge, partitioned by a plurality of partitioning walls; a connecting portion, which is provided as a part of one of the partitioning walls, and is penetrable by a connecting needle; a stray ink catching portion, which is independent from the ink storage portion, is located within the case, away from the ink storage portion, and holds the ink which has leaked from the ink storage portion; and a connecting needle cleaning portion, which is formed of wafer repellent elastic substance, and is penetrable by the connecting needle.

In the case of the structural arrangement in the above described ink cartridge, however, attention has been paid only to the stray ink which adheres to the connecting needle, and the stray ink is wiped and retained by the stray ink catching portion. Thus, it is necessary for the stray ink catching portion to be large enough to assure that even if the connecting and disconnecting of the ink cartridge is repeated substantial number of times, the stray ink which adheres to the connecting needle each time connection and disconnection of the ink cartridge occurs can be always completely wiped and retained by the stray ink catching portion. This need for a large stray ink catching portion has been a significant problem from the standpoint of storage efficiency improvement.

Further, Japanese Laid-Open U.M. Application 59-131837 (U.S. Pat. No. 4,700,202) discloses an ink cartridge structure such that an ink cartridge which is enabled to deliver ink by being penetrated by a hollow connecting needle is provided with an ink absorbing member, which is positioned on the outward side of a sealing member.

However, the studies made by the inventors of the present invention revealed that this structural arrangement suffered from the following problems. That is, in the case of an ink container having this structural arrangement, when the number of the repetitions of the connection and disconnection of the ink container was smaller, the stray ink could be thoroughly wiped away by the stray ink catching portion. However, as the number of the repetition of the connection and disconnection of the ink container became larger, the stray ink catching portion sometimes failed to thoroughly wipe the stray ink away, even when some regions of the stray ink catching portion were not retaining any ink.

Further, any of the above described structural arrangements limits the means for connecting an ink container to a recording apparatus to a hollow needle capable of penetrating the elastic member of the ink container, making it necessary to provide the recording apparatus with a device or mechanism for eliminating the possibility that a user could be hurt by accidentally touching the hollow needle of the recording apparatus when the recording apparatus is not fitted with the ink container In other words, it increases the number of restraints regarding the recording apparatus Thus, it has been desired to solve the above described problems without relying solely upon a hollow needle.

SUMMARY OF THE INVENTION

The primary object of the present invention is to solve the above described problems, and to provide a liquid container which is high in ink storage efficiency, does not cause ink dripping or the like problem even when it is connected or disconnected substantial number of times, and is superior in terms of ease of handling, and also to provide a method for disconnecting such a liquid container.

According to an aspect of the present invention, there is provided a liquid container comprising a liquid storing portion, which is enabled to be connected to, or disconnected from, a supply tube connected to a liquid ejecting recording head, and which is for storing the liquid to be supplied to the liquid ejecting recording head, and a liquid outlet, through which the liquid within the liquid storing portion is delivered to the recording head as it is connected to the supply tube, further comprises a capillary force generating member for generating the capillary force for causing the stray portions of the recording liquid, which have adhered to the surface of the supply tube and the internal surface of the ink outlet, to be absorbed into a space different from the liquid storing portion (space) within the liquid container, wherein the capillary force A of a region of the capillary force generating member, which is located next to the liquid outlet for absorbing the stray portion of the recording liquid left behind within the liquid outlet, and the capillary force B of another region of the capillary force generating member for storing the stray portion of the recording liquid having been absorbed into the absorbing region of the capillary force generating member, satisfy an inequity: $A<B$.

According to another aspect of the present invention, there is provided a liquid container, which is enabled to be connected to, or disconnected from, a liquid ejecting recording apparatus provided with a means for drawing out the liquid from a liquid container, and comprises a liquid storing portion in which liquid is directly stored, and a liquid outlet into which the liquid drawing tube of the aforementioned means for drawing out the liquid from a liquid container, can be inserted, further comprises a first capillary force generating member in the form of a ring, and a second capillary force generating member, wherein the liquid outlet of the liquid container comprises a liquid delivery tube which constitutes the actual liquid outlet, and a cover for covering the outward opening of the liquid delivery tube; the first capillary force generating member is disposed between the cover and liquid delivery tube; the second capillary force generating member is disposed in contact with the first capillary force generating member, and is protected by the cover, and the capillary force A of the first capillary force generating member and the capillary force B of the second capillary force generating member satisfy an inequity: $A<B$.

According to a further aspect of the present invention, a liquid container comprising a liquid storing portion in which liquid is directly stored, and a liquid outlet through which the liquid within the liquid storing portion is drawn out, further comprises a liquid absorbing member comprising first and second capillary force generating members for absorbing the stray portion of the liquid left behind within the ink outlet as the liquid container is disconnected, and the liquid absorbing member is extended outward of the liquid outlet from the inside of the liquid outlet. Therefore, even if the liquid from the liquid storing portion is left behind by a certain amount in the liquid outlet when disengaging the liquid drawing tube of the means for drawing the liquid out of the liquid container, which has been inserted into the liquid outlet, by disconnecting the liquid container from the means for drawing out the liquid from a liquid container, of the liquid ejecting recording apparatus, the stray portion of the liquid is absorbed and retained by the liquid absorbing member. Since the liquid absorbing member extends outward of the liquid outlet from the inside of the liquid outlet, it is possible for the liquid retained in the liquid absorbing member to evaporate from the second capillary generating portion, that is, the outwardly extending portion of the liquid absorbing member. Therefore, the absorbency of the liquid absorbing member remains virtually intact even after the liquid container has been connected and disconnected a substantial number of times. Thus, the problem that recording liquid drips and/or splashes from the liquid outlet of a liquid container when the liquid container is connected or disconnected does not occur, and therefore, the problem that the hands, clothing, and/or the like, of a user is soiled with the liquid does not occur. Further, even in the case of a liquid container, the wall of which is given multiple layers separable from each other, with the use of such technology as blow molding, and in which liquid is directly stored to improve ink storage efficiency, the employment of a liquid absorbing member such as the above described one comprising the first and second capillary force generating members, can prevent the problem that liquid drips and/or splashes from the liquid outlet when the liquid container is disconnected. As a result, the liquid absorbing member for absorbing a certain amount of liquid left behind as the liquid container is disconnected is enabled to remain virtually intact in terms of its absorbency. Therefore, it is possible to provide a liquid container for liquid to be ejected, which is high in ink storage efficiency, does not suffer from such a problem as ink dropping even when the liquid container is connected or disconnected, and is superior in terms of ease of handling.

According to a further aspect of the present invention, there is provided a method for disconnecting a liquid container comprising: a liquid storing portion in which liquid is directly stored; a liquid outlet through which the liquid within the liquid storing portion is drawn out; and a liquid absorbing member extending outward of the liquid outlet from the inside of the liquid outlet, from a liquid drawing means which comprises a tube for drawing out the liquid within the liquid storing portion and draws the liquid out of the liquid storing portion, after connecting the liquid container to the liquid drawing means for drawing out the liquid within the liquid container, comprises: a liquid absorbing step in which the liquid adhering to the internal surface of the liquid outlet is absorbed with the use of the region of the liquid absorbing member exposed to the internal space of the liquid outlet; a liquid transferring step in which the absorbed liquid is transferred into the region of the liquid absorbing member on the outward side of the liquid outlet; and a liquid evaporating step in which the transferred liquid evaporates from the region of the liquid absorbing member on the outward side of the liquid outlet.

According to the above described method for disconnecting a liquid container from a liquid drawing means for drawing out the liquid within the liquid container, when disconnecting a liquid container for containing liquid to be ejected, comprising a liquid storing portion, a liquid outlet, and a liquid absorbing member, from a liquid drawing means comprising a liquid drawing tube insertable into the liquid outlet of the liquid container, after the liquid container is connected to the liquid drawing means, the liquid adhering to the surface of the liquid delivery hole of the liquid outlet is absorbed by the liquid absorbing member, is transferred into the region of the liquid absorbing member on the outward side of the liquid outlet, and is evaporated from the region of the liquid absorbing member on the outward side of the liquid outlet. Therefore, as described above, the problem that when the liquid container is connected or disconnected, the liquid left behind in the liquid outlet drips and/splashes from the liquid outlet, does not occur, and therefore, the problem that when the liquid container is connected or disconnected, the hands, clothing, and/or the like, of a user are soiled with the liquid, does not occur. Further, even in the case of a liquid container, the wall of which is given multiple layers separable from each other, with the use of such technology as blow molding, and in which liquid is directly stored to improve ink storage efficiency, the employment of a liquid container disconnecting means such as the above described one can eliminate such a problem that when a liquid container is disconnected, the liquid left behind in the liquid outlet drips and/or splashes from the liquid outlet, eliminating therefore, the problem that the hands, clothing, or the like, of a user are soiled by the liquid, when disconnecting the liquid container. Further, even in the case of a liquid container, such as a conventional one, the wall of which is given multiple layers separable from each other, with the use of such technology as blow molding, and in which liquid is directly stored to improve ink storage efficiency, the employment of a liquid container disconnecting method such as the above described one can eliminate the problem that when the liquid container is disconnected, recording liquid drips and/splashes from the liquid outlet of the liquid container. As a result, even when a liquid container, the wall of which is given multiple layers separable from each other, in order to improve ink storage efficiency, is employed, the liquid container can be easily disconnected without causing such a problem as ink dripping and/or ink splashing.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the appended drawings.

(Embodiment 1)

Figure 1:
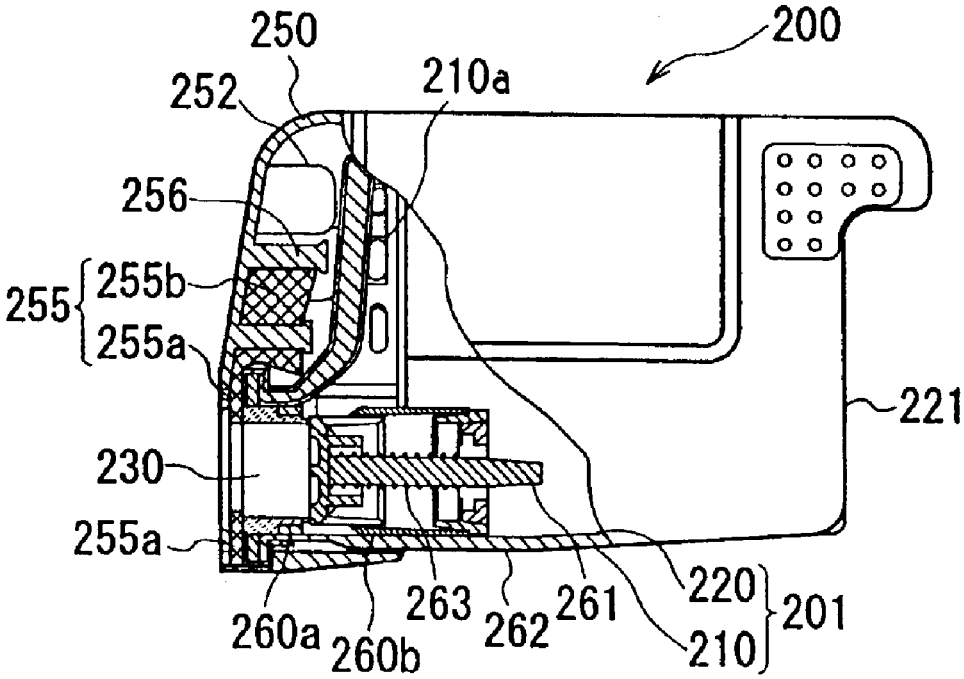
FIG. 1 is a sectional view of the essential portion of the ink container unit in the first embodiment of the present invention.

FIG. 1 is a sectional view of the essential portions of the ink container unit, as a liquid container, in the first embodiment of the present invention. As shown in FIG. 1, the ink container unit 200 in this embodiment comprises: an ink container 201 as a liquid storing portion; a valve mechanism inclusive of a first valve frame 260*a* and a second valve frame 260*b*; and an ID member 250 as an identification member. The ink container unit 200 is removably mounted in an inkjet recording apparatus as a liquid ejecting recording apparatus. In this embodiment, the ink container unit 200 is removably mounted in a holder to which a liquid delivering means for drawing out the ink within the liquid container unit 200 is fixed; in other words, an ink cartridge comprising the holder with the ink delivering means, the ink container unit 200, and the like, is mounted in an inkjet recording apparatus.

The ink container 201 is enabled to generate negative pressure, and is a hollow container, approximately in the form of a polygonal pillar. It comprises an external shell 210, and an internal pouch 220 as a liquid storing pouch. The internal pouch 220 is enclosed in the external shell 210. They are separable from each other. The internal pouch 220 is flexible, being therefore enabled to deform as ink, as recording liquid therein, is drawn out of it. Further, the internal pouch 220 has a pinch-off portion 221 (welding seam portion), which contributes to the proper support of the internal pouch 220 by the external shell 210. It also has an air vent (unshown), which is located adjacent to the pinch-off portion 221, and through which ambient air is allowed to enter between the internal pouch 220 and external shell 210.

To the ink container 201, a valve mechanism is welded. The valve mechanism has a joint hole 230, which is connected to a joint pipe 180, which will be described later with reference to FIG. 3, to deliver ink to the joint pipe 180. The valve mechanism has a first valve frame 260*a*, a second valve frame 260*b*, a valve plug 261, a valve cover 262, and a pressure generating member 263. The valve mechanism with the joint hole 230 is positioned so that it will be at the bottom of the ink container unit 200 when the ink container unit 200 is in use. The valve plug 261 is slidably fitted in the second valve plug 260*b*, and is kept under the pressure generated in the direction of the first valve frame 260*a* by the pressure generating member 263. When the joint pipe 180 is not within the joint hole 230, the first valve frame 260*a* side edge of the valve plug 261 is kept pressed against the first valve frame 260*a*, by the resiliency of the pressure generating member 263, keeping the ink container unit 200 hermetically sealed. As the joint pipe 180 is inserted into the joint hole 230, the joint pipe 180 is disengageably connected to the joint hole 230, and opens the valve mechanism.

The ID member 250 is for preventing the erroneous mounting of the ink container unit 200. The ID member has a plurality of ID recesses 252, located on the left and right sides of the ID member, in a manner to correspond to a plurality of ID members 170 (FIG. 3), which will be described later with reference to FIG. 3. The ID member 250 is fixed to the external shell 210 of the ink container 201. The ID member 250 makes it possible for an ink container to be mounted only to a position which corresponds in ink type to the ink container, in an inkjet recording apparatus.

As for the fixing of the ID member 250 to the external shell 210, a surface of the external shell 210, which faces the sealing surface of the first valve frame 260*a*, at which the first valve frame 260*a* is connected to the ink container 201, is engaged with the click portion of the ID member 250, which is a part of the bottom portion of the ID member 250, and the catch portion 210*a* on the side surface of the external shell 210 is engaged with the corresponding click portion on the ID member 250 side. Therefore, the ID member 250 is securely fixed to the ink container 201.

Figure 3A:
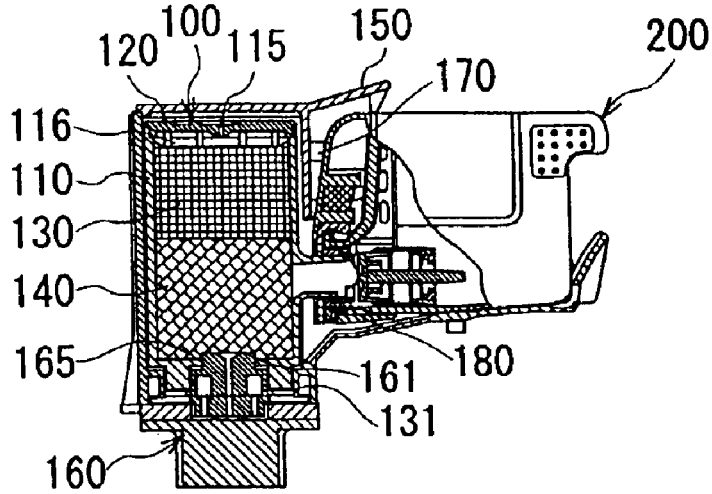
FIG. 3 is a sectional view of the essential portions of the ink container unit shown in FIG. 1, and an inkjet head which can be connected to, or disconnected from, the ink container unit, for showing the process for disconnecting the two.
Figure 3B:
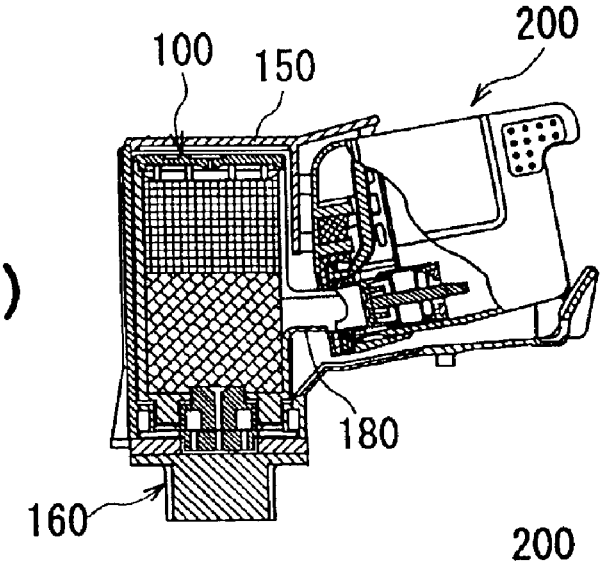
Figure 3C:
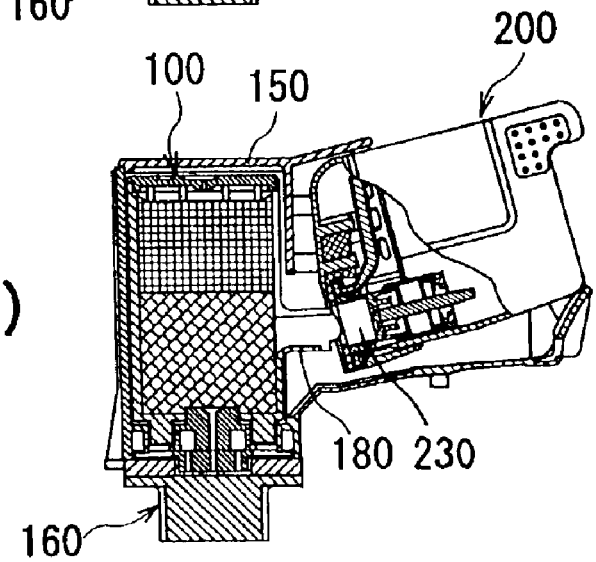

As regards the mounting error prevention function which is realized by the ID member and ID recess 252, the mounting error prevention mechanism is realized by providing the ID member 250 with the plurality of the ID recesses 252, which correspond to the plurality of ID members 170 with which a negative pressure control chamber unit 100, which will be described later with reference to FIG. 3, is provided. Thus, various ID functions can be realized by varying the configurations and positions of the ID members 170 and ID recesses 252.

The ink re-absorbing member 255, which is a liquid absorbing member, that is, an absorbing means, is placed within the internal space of the ID member 250, which is on the ink container 201 side and is different from any of the ID recesses 252. It is securely held to the ID member 250 with the use of an ink re-absorbing member retainer 256. The perspective view of the ink re-absorbing member 255 is FIG.

2. Although the ink re-absorbing member 255 is formed in a single piece, it can be conceptually divided into two regions in terms of external appearance and function. One of the two regions of the ink reabsorbing member 255 is in the form of a thin ring, and has a hole 255*c*, which is smaller in cross section than the hole of the first valve frame 260*a*. It is an ink absorbing region 255*a* confined in the space between the first valve frame 260*a* and ID member 250. It is located next to the joint hole 230, with the hole 255*c* connected to the joint hole 230. The liquid outlet is constituted of the first valve frame 260*a*, which is an ink delivery tube having the joint hole 230, the portion of the ink re-absorbing member 255 adjacent to the joint hole 230, and the portion of the ID member 250 adjacent to the joint hole 230. The ink absorbing region 255*a* of the ink re-absorbing member 255 is exposed at the inward surface of the ink outlet. Thus, after the valve mechanism is closed as the ink container unit 200 is dismounted from the inkjet recording apparatus, the ink remaining between the outward edge of the joint hole 230 and the valve mechanism is absorbed by the portion of the ink re-absorbing member 255, which is exposed to the internal space of the ink outlet.

Figure 2:
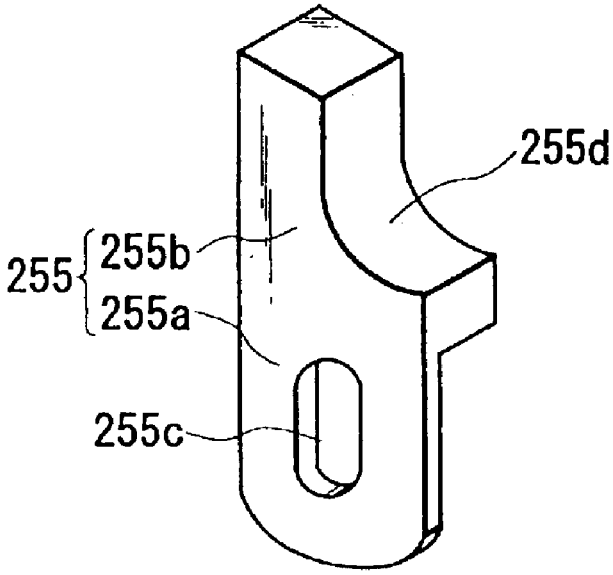
FIG. 2 is a perspective view of the ink re-absorbing member shown in FIG. 2, for showing the configuration thereof.

Another region of the ink re-absorbing member 255 is thicker than the above described ring-shaped region, and is large enough to virtually fill up the space above the ID member 250. It is an ink storing region designated by a referential code 255*b* in FIG. 2. The ink storage region 255*b* is provided with a recess 255*d* so that it matches in shape with the recess-less space of the ID member 250. The ink storage region 255*b* is positioned so that it will be above the ink absorbing region 255*a* when the ink container unit 200 is in usage. In other words, the ink re-absorbing member 255 extends upward from the inward surface of the ink outlet into the internal space of the ID member 250, that is, outward of the ink outlet. The ID member 250 also functions as a cover which covers the outward edge portion of the first valve frame 260*a*, and the ink re-absorbing member 255; the ink re-absorbing member 255 is protected by the ID member 250, eliminating the possibility that the ink having been absorbed by the ink re-absorbing member 255 might soil the hands of a user.

The ink re-absorbing member 255 is a piece of capillary force generating material. In this embodiment, it is a piece of fibrous substance uniform in fiber direction. However, substances other than the fibrous substance, which generate capillary force, may be used as the material for the ink re-absorbing member 255; for example, foamed urethane, porous substances formed by molding, sintering, or the like, may be employed. Further, the ink re-absorbing member 255 may be such material that generates capillary force with the use of fine tubes.

Next, the function of the ink re-absorbing member 255 will be described along with the mechanism of the ink dripping, which occurs as the ink container unit 200 is separated from the negative pressure control chamber unit 100. FIG. 3 shows the steps through which the ink container unit 200 in this embodiment is dismounted from the inkjet cartridge in which the ink container unit 200 has been removably mounted. FIG. 3(*a*) shows the ink container unit 200 and inkjet cartridge in the properly connected state; FIG. 3(*b*), the ink container unit 200 and inkjet cartridge during their separation from each other; and FIG. 3(*c*) shows the state in which ink container unit 200 and inkjet cartridge are perfectly in connection to each other.

The inkjet cartridge comprises: an inkjet head unit 160 as a recording element; a holder 150; the negative pressure control chamber unit 100 as a liquid drawing means; the ink container unit 201; and the like. The negative pressure control chamber unit 100 is securely held with the holder 150, and the inkjet head unit 160 is fixed to the bottom end of the negative pressure control chamber unit 100, with the interposition of the holder 150. Regarding the means for securing the holder and negative pressure control chamber unit 100 relative to each other, and the means for securing the holder 150 and inkjet head unit 160 relative to each other, such a means as using screws, providing the components with snap-fitting features, or the like, that allows the above described components to be easily disassembled from each other is preferable, since ease of disassembly is effective for cost reduction in recycling, structural modification for upgrading, or the like. Further, ease of disassembly is also preferable due to the fact that the various components are different in service life length; ease of disassembly makes it easier to replace the components which need to be replaced. However, under certain circumstances, such means as welding, thermal crimping, or the like, may be used to permanently fix the components to each other, which is obvious.

The negative pressure control chamber unit 100 has a negative pressure control chamber container 110 which has a hole in the top wall; a negative pressure control chamber lid 120 attached to the top wall of the negative pressure control chamber container 110; and two absorbent members 130 and 140, which fill the negative pressure control chamber container 110 to absorb and remain ink. The absorbent members 130 and 140 fill the negative pressure control chamber container 110, remaining in contact with each other, in such a manner that when the inkjet head cartridge is in use, they will be vertically layered. The amount of the capillary force which the absorbent member 140, or the bottom layer, generates is greater than that which the absorbent member 130, or the top layer, generates. Therefore, the absorbent member 140, the bottom layer, is greater in ink retaining capability. The ink within the negative pressure control chamber unit 100 is supplied to the inkjet head unit 160 through an ink supply tube 165.

On the other hand, the inkjet head unit 160 comprises: an ink path (unshown) in connection with the ink supply tube 165; a plurality of nozzles (unshown), each of which is equipped with an energy generating element (unshown) for generating ink ejection energy; and a common liquid chamber which temporarily holds the ink supplied through the ink path, and from which the ink is supplied to each nozzle. The energy generation element is connected to the terminal with which the holder 150 is provided. The terminal of the holder 150 becomes connected to the electrical control system of the recording apparatus as the holder 150 is mounted on the carriage of the inkjet recording apparatus. A recording signal from the recording apparatus is sent to the energy generation element of the inkjet head unit 160 through the terminal of the holder 150 to drive the energy generation element to give ejection energy to the ink within the nozzle. As a result, the ink is ejected from an ejection orifice, that is, the outward end of the nozzle. As the ejected ink adheres to a recording medium such as a piece of paper, an image in the form of a letter, a figure, or the like, is recorded on the recording medium.

An ink delivery opening 131, which is the end of the ink delivery tube 165, on the absorbent member 140 side, is fitted with a filter 161, with the filter 161 pressing on the absorbent member 140. The ink container unit 200 is structured so that it can be removably mounted in the holder 150. The joint pipe 180, which is a part of the negative pressure control chamber container 110, located on the ink container unit 200 side of the negative pressure control chamber container 110, and to which the ink container unit 200 is connected, is such a pipe that will have been inserted into, being therefore connected to, the joint hole 230 of the ink container unit 200 when the ink container unit 200 is properly placed in the holder 150. The negative pressure control chamber unit 100 and ink container unit 200 are structured so that as the joint pipe 180 and joint hole 230 are connected to each other, the ink within the ink container unit 200 is supplied into the negative pressure control chamber unit 100. In other words, the joint pipe 180 is a liquid delivery pipe for drawing the ink within the ink container unit 200 into the negative pressure control chamber unit 100; it is a liquid drawing tube through which the ink within the ink container unit 200 is drawn into the negative pressure control chamber unit 100. The negative pressure control chamber unit 100 is provided with the ID member 170, which is for preventing the ink container unit 200 from being erroneously mounted, projects outward from a portion of the external surface of the negative pressure control chamber container 110, and is on the ink container unit 200 side of the negative pressure control chamber container 110 and above the joint pipe 180.

The negative pressure control chamber lid 120 is provided with an air vent 115 for connecting the internal space of the negative pressure control chamber container 110, more specifically, the absorbent member 130 stored in the negative pressure control chamber container 110, to ambient air. Within the negative pressure control chamber container 110, a buffer space 116 is provided, which is created by the provision of the ribs projecting inward from the absorbent member 130 side surface of the negative pressure control chamber lid 120. The buffer space 116 is the portion of the internal space of the negative pressure control chamber container 110, in which no ink (liquid) is present. It is located next to the air vent 115.

When the ink container unit 200 is connected to the negative pressure control chamber unit 100, the joint pipe 180 is inserted into the joint hole 230, pressing the valve plug 261. As the valve plug 261 is pressed by the joint pipe 180, it moves in the direction to separate from the first valve frame 260*a*. As a result, the internal space of the joint pipe 180 becomes connected to the internal space of the ink container unit 200 through the hole made in the side wall of the second valve frame 260*b*; the hermetically sealed ink container unit 200 is opened to allow the ink within the ink container unit 200 to be drawn into the negative pressure control chamber unit 100 through the joint hole 230 and joint pipe 180. In other words, the ink storage portion of the ink container unit 200 which has remained hermetically sealed becomes connected to the negative pressure control chamber unit 100 only through the above described hole.

Figure 4:
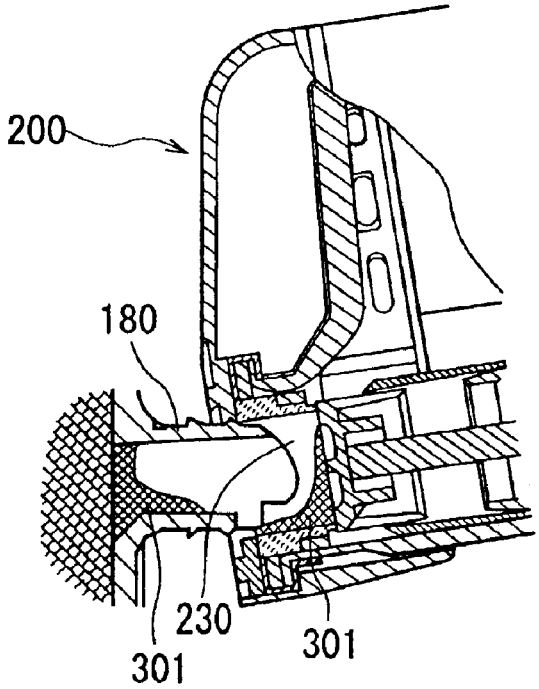
FIG. 4 is an enlarged sectional view of the essential portions of the ink container unit in the state shown in FIG. 3(*b*).
Figure 5:
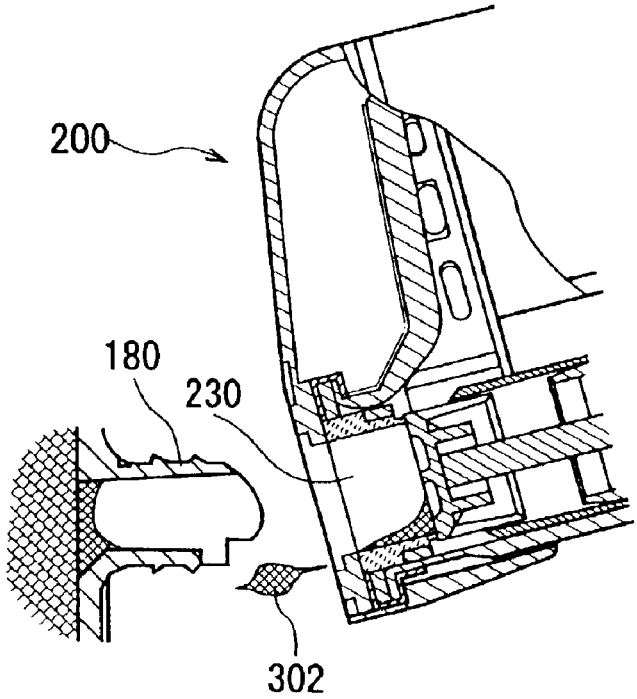
FIG. 5 is an enlarged sectional view of the essential portions of the ink container in the state shown in FIG. 3(*c*), for depicting the ink splash.

When the ink container unit 200 is in connection with the negative pressure control chamber unit 100 as shown in FIG. 3(*a*), the joint pipe 180 remains filled with ink. However, as the ink container unit 200 is separated from the negative pressure control chamber unit 100 as shown in FIG. 3(*b*), air is introduced into the Joint pipe 180 from the bottom side of the outward end of the joint pipe 180, allowing the ink within the joint pipe 180 and joint hole 230 to be absorbed into the negative pressure control chamber unit 100 due to the capillary force of the absorbent member 140 within the negative pressure control chamber unit 100. In this situation, if the speed at which the ink container unit 200 is separated from the negative pressure control chamber unit 100 is greater than the speed at which the ink is absorbed into the negative pressure control chamber unit 100, the separation ends with a certain amount of the ink left behind in the joint pipe 180 and joint hole 230; some of the ink is left in the joint pipe 180, and the other is left in the joint hole 230. The ink left in the joint pipe 180 is absorbed into the negative pressure control chamber unit 100. As for the ink 301 left in the joint hole 230, if the ink re-absorbing member is not present as shown in FIG. 4 the Ink 301 in the joint hole 230 remains unabsorbed since the valve mechanism on the ink container unit 200 side has been closed. In this situation, the ink left in the joint hole 230, or stray ink, fails, due to its inertia, to follow the ink container unit 200 which is moving away. As a result, some of the ink 301 left in the joint hole 230 is released into the air as shown in FIG. 5, turning into a stray ink droplet 302, which leads out of the joint hole 230, dripping or splashing.

Figure 6:
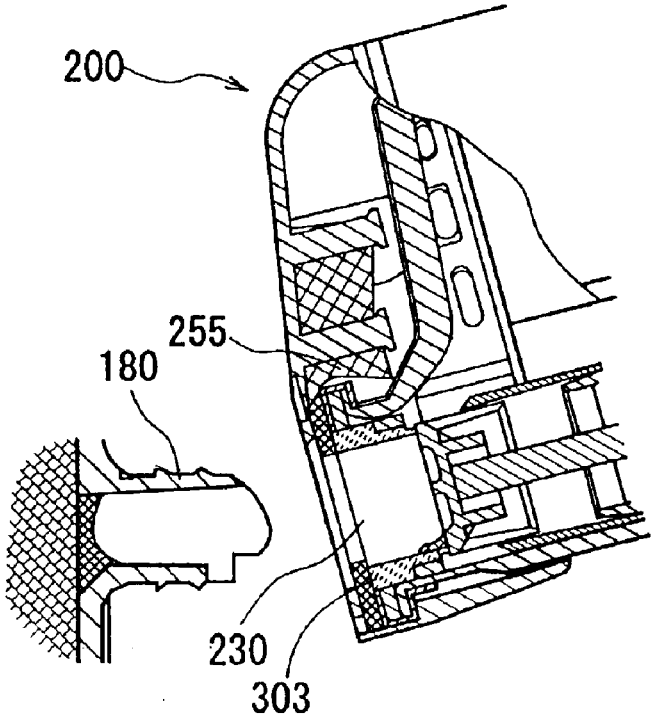
FIG. 6 is an enlarged sectional view of the essential portions of the ink container in the state shown in FIG. 5, for depicting the effect of the ink re-absorbing member.

The ink re-absorbing member 255 is provided as a means for absorbing the aforementioned ink left behind in the joint hole 230. Referring to FIG. 6, the ink left in the joint hole 230, that is, the ink adhering to the surface of the joint hole 230, comes into contact with the edge 255*c* of the ink re-absorbing member 255, and then is absorbed into the ink absorbing region 255*a* from this edge 255*c*. The absorbing ink 303 is retained within the ink re-absorbing member 255, and the liquid components of the absorbed ink 303 evaporate with time. The diameter of the hole 255*c* of the ink re-absorbing member 255 is made slightly smaller than the diameter of the joint hole 230. Therefore, the ink left within the joint hole 230 is enabled to easily come into contact with the edge portion of the hole 255*c* of the ink re-absorbing member 255.

In the above, the present invention was described with reference to an ink container in which ink is directly stored. However, an ink re-absorbing member in accordance with the present invention is also applicable to a liquid container of a conventional type in which ink is stored with the use of capillary force from an ink absorbing member. The effects of such an application will be similar to those described above regarding this embodiment.

The ink absorbing capacity of the ink absorbing region 255*a* is only twice the amount of the ink which might be left behind in the joint hole 230 each time the ink container unit 200 is disconnected. However, if the ink container unit 200 is disconnected after it has already been disconnected two or more times, the absorbed ink moves to the ink storage region 255*b* from the top portion of the ink absorbing region 255*a*. Since the ink storage region 255*b* is kept compressed by being secured by the ink re-absorbing member holder 256, the capillary force in this region is greater than that of the ink absorbing region 255*a*. In other words, when A and B represent the capillary forces of the ink absorbing region 255*a* and ink storage region 255*b*, respectively, an inequity: $A<B$ is satisfied.

Therefore, the ink within the ink absorbing region 255*a* swiftly moves into the ink storage region 255*b*, always leaving the ink absorbing region 255*a* in the condition under which the ink absorbing region 255*a* is capable of absorbing ink. Thus, even if the ink container unit 200 is disconnected a large number of times with short intervals, the ink absorbing region 255*a* is always capable of dealing with the ink left behind in the joint hole 230. Further, even if the hands of a user happen to come into contact with the ink storing region 255*b*, there is little possibility that the hands will be soiled with ink. As for the ink absorbing capacity of the ink storage region 255*b*, it is eight times the amount of the ink which will be left behind in joint hole 230 each time the ink container unit 200 is disconnected. Thus, the overall ink absorbing capacity of the ink re-absorbing member 255 is ten times, that is, a combination of twice by the ink absorbing region 255*a* and eight times by the ink storage region 255*b*, the amount of the ink which will be left behind within the joint hole 230 and will have to be absorbed by the ink absorbing region 255*a* each time the ink container unit 200 is disconnected.

It is possible that in reality, there is a certain amount of interval between a given operation for disconnecting an ink container unit and the following operation for disconnecting the same ink container. Further, it is assured that the ID member 250 is not placed in contact with the ink container 201 without any gap between them. In other words, a gap is provided as a passage between the ID member 250 and ink container 201. The space within the ID member 250, that is, the space for holding the ink reabsorbing member 255 within the ink container unit 200, is connected to the atmospheric air through this gap. Therefore, it can he expected that the ink evaporates from the ink re-absorbing member 255 through this gap between the ID member 250 and ink container 201. It is mainly the liquid components of the ink retained by the ink storage region 255*b*, that is, the liquid components retained in the outward portion of the ink delivery portion of the ink re-absorbing member 255, that vaporate through the gap between the ID member 250 and ink container 201. Because of the above described evaporation of the liquid components of the ink, the ink re-absorbing member 255 is capable of dealing with such an amount of the ink which will be left behind in the joint hole 230, that is equivalent to approximately twenty times the amount of the ink which will be left behind in the joint hole 230 and will have to be absorbed by the ink absorbing region 255*a* each time the ink container unit 200 is disconnected. In other words, in consideration of the number of times the ink container unit 200 is connected to, and disconnected from, the negative pressure control chamber unit 100 until the ink within the ink container unit 200 is completely used, the ink absorbing capacity of the ink re-absorbing member 255 is more than sufficient. Instead of providing the gap between the ID member 250 and ink container unit 201 in order to connect the space for storing the ink re-absorbing member 255 to the atmospheric air, an opening such as a hole, as an air passage, may be provided between the ID member 250 and ink container 201, or the ID member 250 itself may be provided with such an opening.

As described above, in the case of the ink container unit 200 in this embodiment, even when a certain amount of ink is left behind astray in the joint hole 230 as the ink container unit 200 is disconnected from the negative pressure control chamber unit 100, the stray ink in the joint hole 230 is absorbed and retained by the ink re-absorbing member 255. Therefore, the problem that when the ink container unit 200 is disconnected, ink drips and/or splashes from the joint hole 230, does not occur, preventing the hands and/or clothing of a user from being soiled by liquid.

The extension of the ink re-absorbing member 255 from the surface of the joint hole 230 outward of the joint hole 230 allows the liquid components of the ink retained by the ink re-absorbing member 255 to evaporate from the outwardly extending portion of the ink re-absorbing member 255. Therefore, even when the ink container unit 200 is connected and disconnected a plural number of times with relatively short intervals, the ink re-absorbing member 255 remains sufficiently absorbent.

Further, even in the case of a liquid container, such as a conventional liquid container, the wall of which is given a plurality of layers separable from each other; with the use of such a molding technology as blow molding, and in which liquid is directly stored to improve ink storage efficiency, the employment of a liquid absorbing member similar in function to the ink re-absorbing member 255 can prevent recording liquid from dripping and/or splashing from the ink delivery hole, when the ink container unit 200 is separated from the negative pressure control chamber unit 100. Consequently, the liquid absorbing member for absorbing the liquid left behind in the liquid outlet is enabled to remain sufficiently absorbent, and it is possible to realize a liquid container which is high in ink storage efficiency, does not allow problems such as ink dripping even during its connection and disconnection, and is superior in terms of ease of handling.

(Embodiment 2)

Figure 7:
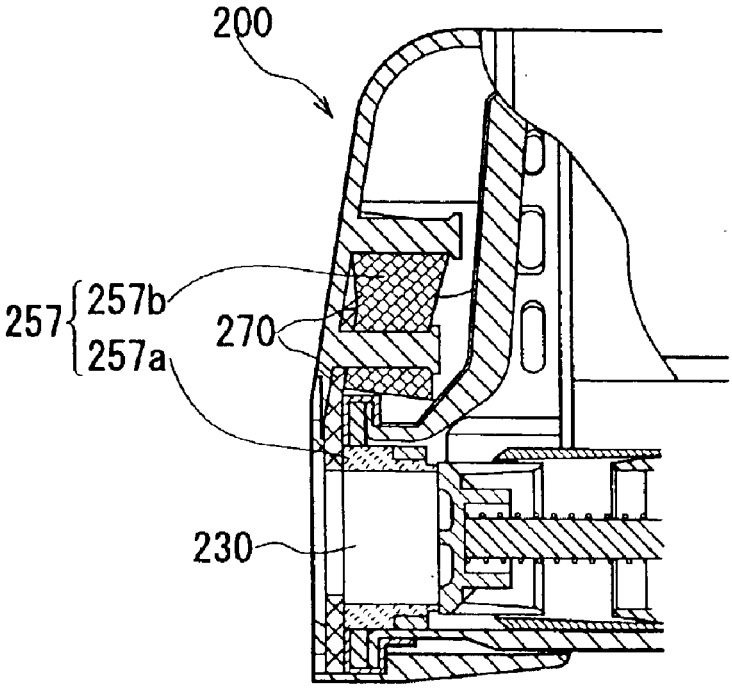
FIG. 7 is a sectional view of the essential portion of the ink container unit in the second embodiment of the present invention.

FIG. 7 is a sectional view of the essential portion of the ink container unit, that is, a liquid container, in the second embodiment of the present invention.

As depicted in FIG. 7, the ink container unit in this embodiment employs an ink re-absorbing member 257 in the place of the ink re-absorbing member 255 of the ink container unit 200 in the first embodiment. The ink re-absorbing member 257 comprises two members: an ink absorbing member 257*a* as a capillary force generating first member, and an ink storage member 257*b* as a capillary force generating second member. The two members are in contact with each other at an interface 270. The ink storing member 257*b* and ink absorbing member 257*a* are positioned so that the top portion of the ink storing member 257*b* will be above the ink absorbing member 257*a* when the ink container unit is in use. The ink absorbing member 257*a* is in the form of a thin ring as is the ink absorbing region 255*a* of the ink re-absorbing member 255 in the first embodiment. It has a hole smaller in cross section than the first valve frame 260*a*, and is disposed within the space between the first valve frame 260*a* and ID member 250 in a manner of being sandwiched by the first valve frame 260*a* and ID member 250.

The ink absorbing member 257*a* and ink storing member 257*b* are protected by the ID member 250. Therefore, there is no possibility that the hands of a user will be soiled by the ink having been absorbed in the ink absorbing member 257*a* and ink storing member 257*b*. The capillary force of the ink storing member 257*b* is rendered greater than that of the ink absorbing member 257*a*; there is a substantial difference in capillary force between the two members. In other words, representing the capillary forces of the ink absorbing member 257*a* and ink storing member 257*b* with C and D, an inequity: $C<D$ is satisfied. This setup increases the speed of the ink movement between the two members.

In the case of a single piece ink re-absorbing member such as the ink re-absorbing member 255 in the first embodiment, its configuration is required to conform to the shape of the internal space of the ID member 250. Therefore, a dedicated ink re-absorbing member is necessary for each of the plurality of the ink container units for an inkjet head, since each ink container unit is different in ink color from the others, and therefore, is different in ID member configuration from the others. In comparison, dividing an ink re-absorbing member into two pieces as in the case of the ink re-absorbing member 257, that is, a two piece member, makes it possible to devise the two pieces in terms of the configuration of their front and/or back sides, and/or the direction in which the two pieces are mounted, so that the internal spaces of all the ID members can be properly filled with identical ink re-absorbing members. Therefore, it is possible to reduce component count.

The ink re-absorbing member 257 in this embodiment comprises two members: ink absorbing member 257*a* and ink storing member 257*b*. The ink absorbing member 257*a* may be replaced by a member with grooves, which is capable of generating capillary force, and is placed in a manner to occupy the same location as the ink absorbing member 257*a*. In such a case, the member with grooves may be a part of the ID member 250, or a member independent from the ID member 250.

(Embodiment 3)

Figure 8:
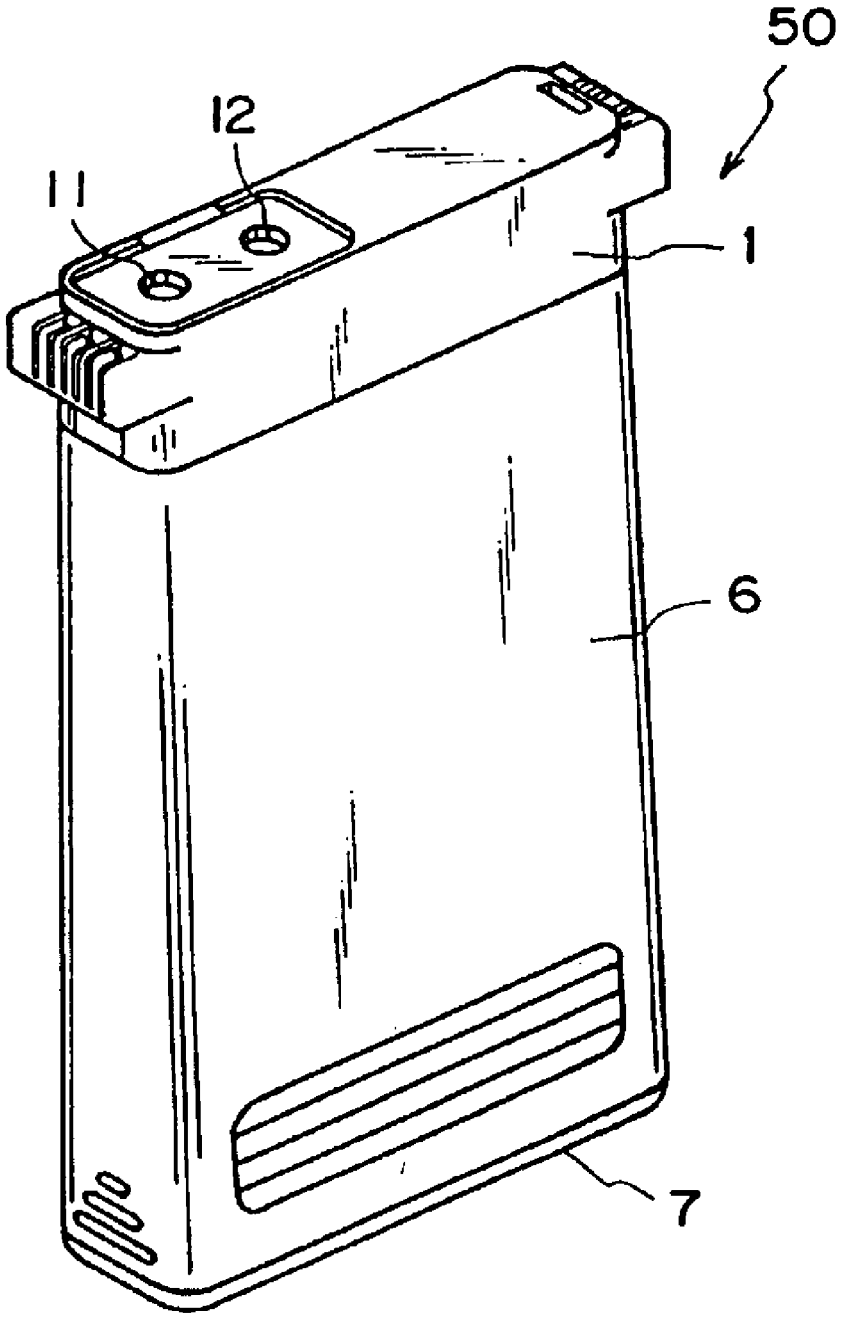
FIG. 8 is a perspective view of the ink container unit in the third embodiment of the present invention.
Figure 9:
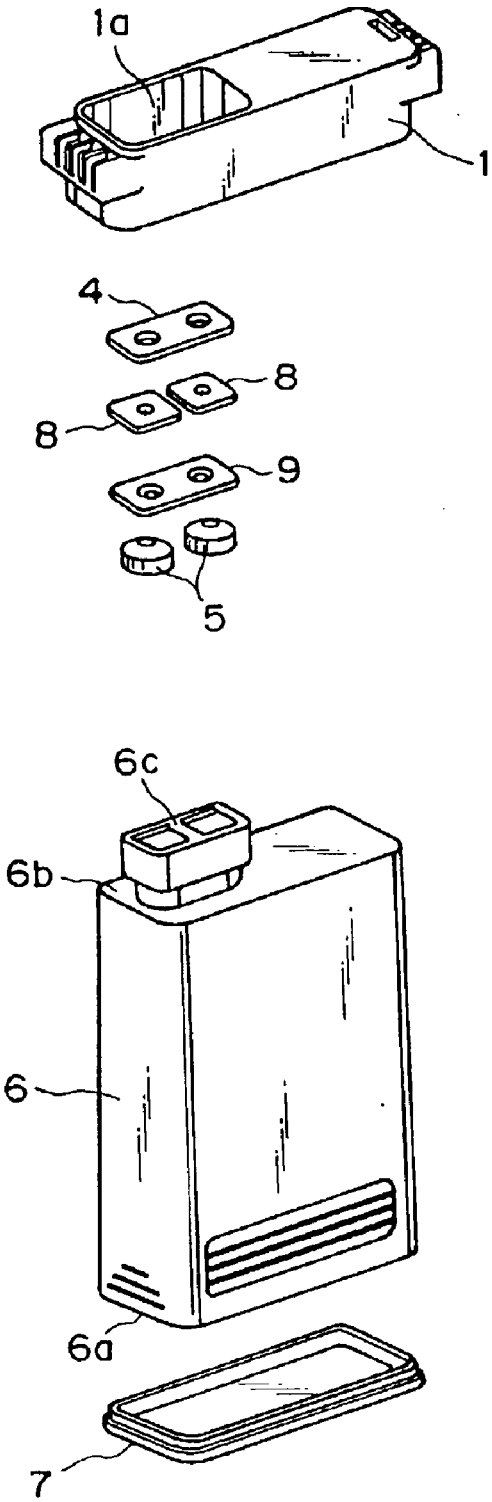
FIG. 9 is an exploded perspective view of the ink container unit in the third embodiment of the present invention.

FIG. 8 is a perspective view of the ink container unit, that is, a liquid container, in the third embodiment of the present invention, and FIG. 9 is an exploded perspective view thereof.

An ink container unit 50 has an ink container 6 and a lid 7. The lid 7 is hermetically attached to the top side 6*a* of the ink container 6, creating an ink storing chamber (unshown), in which ink (liquid to be ejected) is stored. The ink container 6 is provided with a liquid outlet 6*c*, which projects outward from a surface of the ink container 6, on the side opposite to the side to which the lid 7 is attached, that is, the bottom wall 6*b* of the ink container 6. The ink container unit 50 also comprises a bottom cover 1, which is attached to the ink container unit 50 in a manner to encase the liquid outlet 6*c*. The bottom cover 1 is provided with a hole, the position of which corresponds with that of the liquid outlet 6*c*.

The liquid outlet 6*c* has two through holes: liquid delivery first hole 11 and liquid delivery second hole 12, both of which lead to the ink storing chamber. The liquid container unit 6 also comprises: a pair of elastic members 5, which are inserted in the liquid delivery first and second holes 11 and 12, one for one, and holding members 4 and 9, which have a pair of holes, the positions of which correspond to those of the liquid delivery holes 11 and 12, one for one. The holding members 4 and 9 are fixed to the liquid outlet 6*c* by ultrasonic welding, in a manner to keep the elastic members 5 compressed. In other words, the elastic members 5 are held compressed within the liquid delivery holes 11 and 12, one for one, in a manner to virtually hermetically plug the liquid delivery holes 11 and 12. Thus, until the hollow needle on the recording apparatus main assembly side is inserted into the liquid delivery holes 11 and 12 through the elastic members 5, the ink storing chamber 523 is kept hermetically sealed by these elastic members 5 and lid 7. Incidentally, a capillary force generating member 8 is placed between the holding members 4 and 9.

Figure 10A:
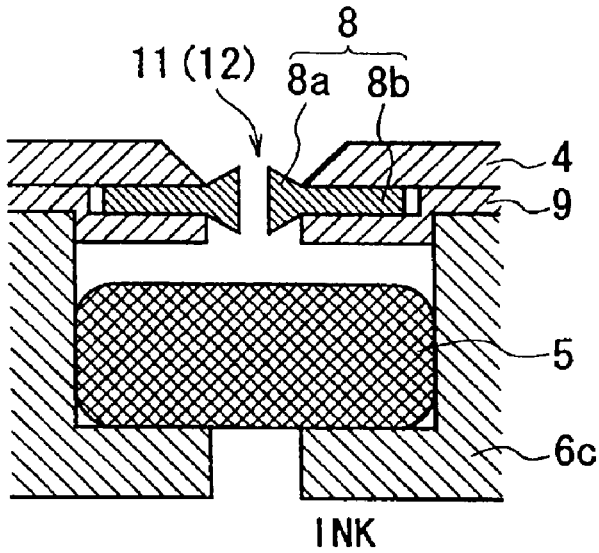
FIG. 10 is a sectional view of the essential portions of the ink container unit in the third embodiment of the present invention.
Figure 10B:
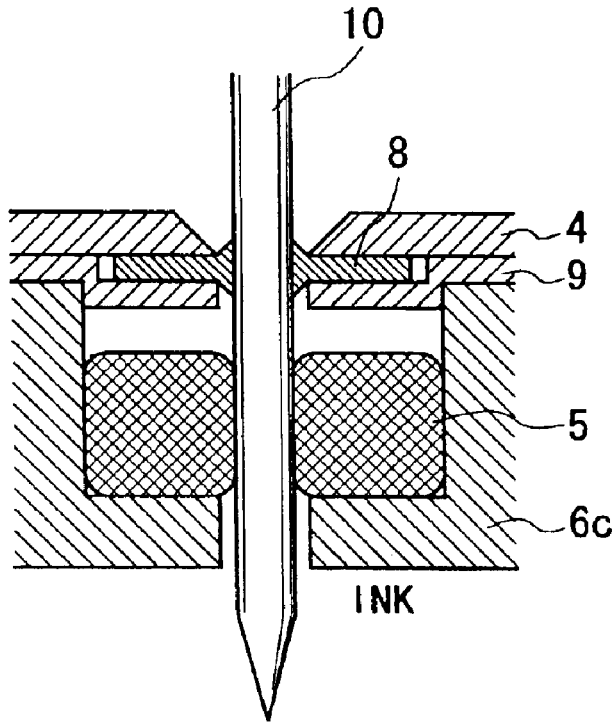

Referring to FIG. 10, at this time, the ink re-absorbing member, which characterizes the present invention, will be described. FIG. 10 is a sectional view of the essential portions of the ink container unit in this third embodiment of the present invention; FIGS. 10(*a*) and 10(*b*) showing the essential portions through which the hollow needle has not been, and has been, inserted into the elastic members 5, respectively.

In this embodiment, the capillary force generating member 8 is formed of felt or the like material, which is virtually uniform in thickness and fiber density. The position of the capillary force generating member 8 is fixed by being sandwiched by the two holding members 4 and 9. Referring to FIG. 10(*a*), as the capillary force generating member 8 is sandwiched by the two holding members 4 and 9, the sandwiched portion of the capillary force generating member 8 is compressed, whereas the portion of the capillary force generating member 8 adjacent to its hole is caused to protrude inward of the ink delivery hole 11 (or 12). As a result, the capillary force generating member 8 is divided into a region 8*a*, as an ink absorbing region, which is relatively small in capillary force, and a region 8*b*, as an ink storing region, which is relatively large in capillary force.

Next, referring to FIG. 10(*b*), after the insertion of the hollow ink delivery needle 10, the ink absorbing region 8*a* of the capillary force generating member 8 is in contact with the hollow needle 10, being therefore enabled to absorb the ink adhering to the needle, and also the ink left on the outward side of the ink delivery hole 11 (or 12) relative to the elastic member 5, as the hollow needle 10 is inserted or pulled out. The ink having been absorbed into the ink absorbing region 8*a* moves into the ink storing region 8*b* due to the difference in capillary force between the two regions. Further, the ink retained in the ink absorbing region 8*a* quickly evaporates because this region is exposed to the atmospheric air. Thus, it is assured that even if the insertion and extraction of the hollow needle are repeated, the ink on the hollow needle and the ink left behind on the outward side of the ink delivery hole 11 (or 12) with respect to the elastic member 5 are absorbed and retained.

Figure 11A:
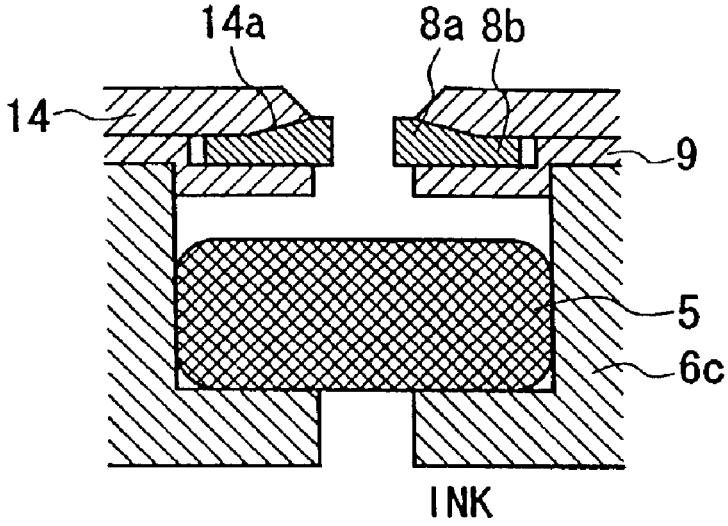
FIG. 11 is a sectional view of the essential portions of modified versions of the ink container in the third embodiment of the present invention.
Figure 11B:
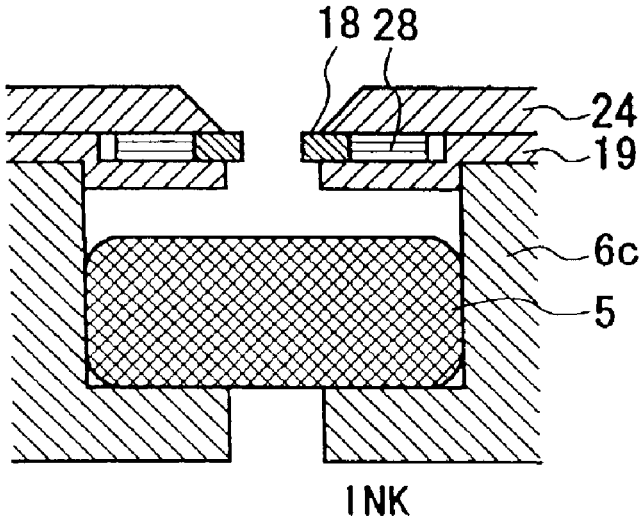

FIG. 11 shows modifications of the capillary force generating member 8 in this embodiment.

In the case of the modification shown in FIG. 11(*a*), the holding member 14 is provided with a tapered portion 14*a*, so that the capillary force of the capillary force generating member gradually changes in terms of the radial direction of the ink delivery hole. In the case of the modification shown in FIG. 11(*b*), the capillary force generating member comprises two portions: a portion 18, which is formed of a piece of felt or a fiber bundle, and is relatively smaller in capillary force, and a groove 28, which is formed as a part of the holding member 24 or 19, and is relatively high in capillary force.

These structural arrangements also provided effects similar to those provided by the preceding embodiments.

While the invention has been described with reference to the structures disclosed herein, it is not confined to the details set forth and this application is intended to cover such modifications or changes as may come within the purposes of the improvements or the scope of the following claims.

What is claimed is:

1. A liquid container for accommodating liquid for recording to be supplied to a liquid ejection recording head, said liquid container being detachably mountable to a supply tube which is in fluid communication with said liquid ejection recording head, said liquid container comprising:

a liquid containing portion for accommodating the liquid for recording;

a supply opening which is provided in said liquid containing portion and into which said supply tube is inserted;

an outer casing covering at least such a side surface of said liquid containing portion as is provided with said supply opening;

a space portion provided between said liquid containing portion and said outer casing; and a capillary force generating member disposed in said space portion and having an opening smaller than said supply opening, said capillary force generating member being positioned by being sandwiched between an outer surface of said supply opening and said outer casing;

wherein said capillary force generating member is constituted mainly by a single member, and has an opening smaller than said supply opening, wherein said capillary force generating member has an absorbing region effective to absorb the liquid for recording and a storing region for storing the liquid for recording absorbed in the absorbing region.

2. A container according to claim 1, wherein a capillary force A of said absorbing region and a capillary force B of said storing region, A<B is satisfied.

3. A container according to claim 1, wherein said capillary force generating member is mainly constituted by two members and has a first capillary force generating member, having an opening smaller than said supply opening, for absorbing the liquid for recording, and a second capillary force generating member, contacted with said first capillary force generating member, for storing the liquid for recording absorbed by said first capillary force generating member.

4. A container according to claim 3, wherein a capillary force A of said first capillary force generating member and a capillary force B of said second capillary force generating member satisfy A<B.

* * * * *